United States Patent [19]

Ito

[11] Patent Number: 4,685,797

[45] Date of Patent: Aug. 11, 1987

[54] COPYING MACHINE CONTROL SYSTEM

[75] Inventor: Masazumi Ito, Toyohashi, Japan

[73] Assignee: Minolta Camera Kabushiki Kaisha, Osaka, Japan

[21] Appl. No.: 778,507

[22] Filed: Sep. 20, 1985

[30] Foreign Application Priority Data

Sep. 21, 1984 [JP] Japan ..... 59-199021
Aug. 1, 1985 [JP] Japan ..... 60-170307

[51] Int. Cl.[4] ..... G03G 21/00
[52] U.S. Cl. ..... 355/14 SH; 355/3 SH
[58] Field of Search ..... 355/3 R, 3 SH, 14 SH, 355/14 R

[56] References Cited

U.S. PATENT DOCUMENTS 3,960,446 6/1976 Ogawa et al. ..... 355/14 SH X
4,062,061 12/1977 Batchelor et al. ..... 355/14 X
4,078,787 3/1978 Burlew et al. ..... 271/3.1
4,113,374 9/1978 Nakamura et al. ..... 355/14
4,264,188 4/1981 Tomosada et al. ..... 355/14 R
4,313,673 2/1982 Wartinger et al. ..... 355/14 R
4,349,269 9/1982 Okada ..... 355/14 SH
4,383,756 3/1983 Hamamoto et al. ..... 355/14 CU

*Primary Examiner*—Fred L. Braun
*Attorney, Agent, or Firm*—Price, Gess & Ubell

[57] ABSTRACT

A multimode copying machine including a document conveying device, a manual paper feeding device and a manual feed mode switching device. The copying machine further includes a switch disposed adjacent to the manual paper feeding device for outputting a document change request signal, and a controller operable in response to the signal output in a manual feed mode to actuate the document conveying device for document changing.

12 Claims, 14 Drawing Figures

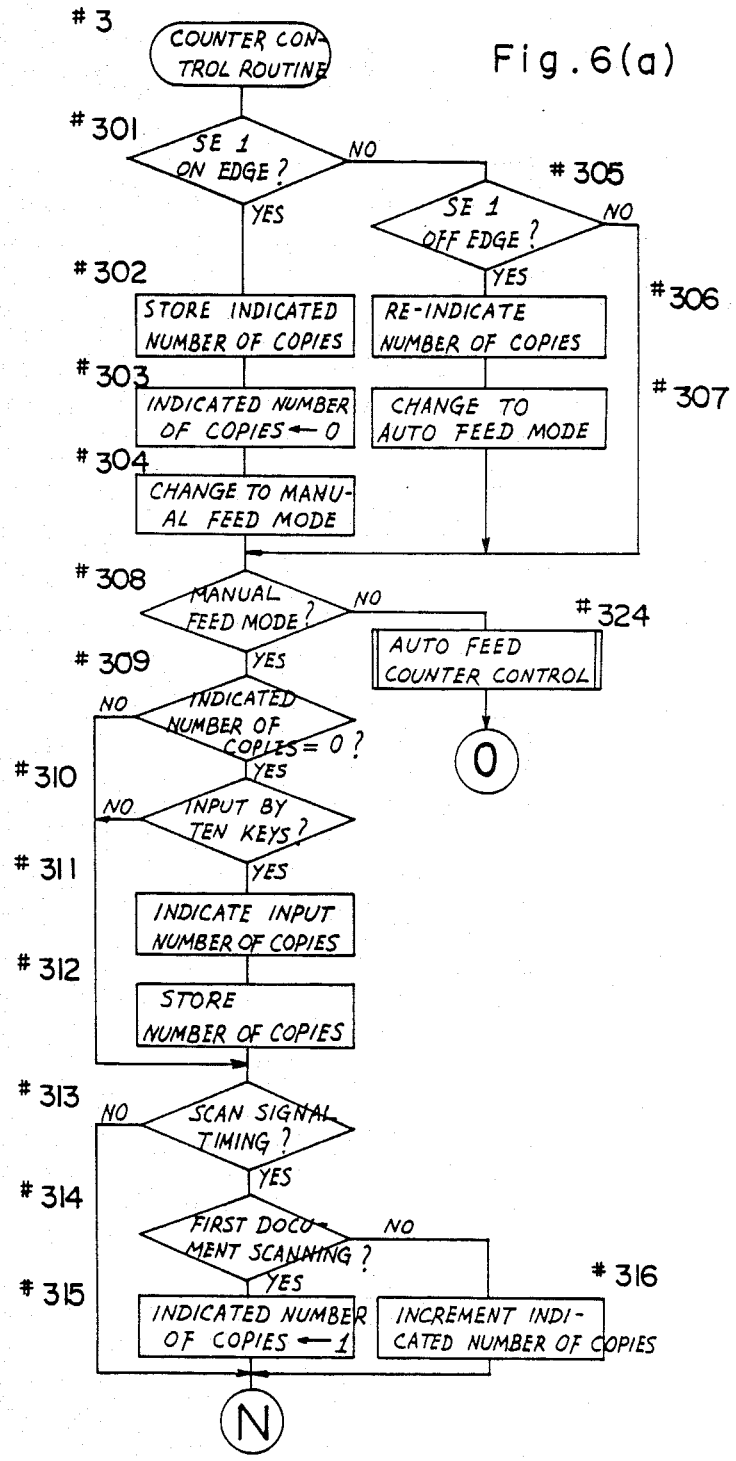
Fig. 6(a)
3
COUNTER CONTROL ROUTINE
301
SE 1 ON EDGE ?
NO
YES
305
SE 1 OFF EDGE ?
NO
YES
302
STORE INDICATED NUMBER OF COPIES
RE-INDICATE NUMBER OF COPIES
306
303
INDICATED NUMBER OF COPIES ← 0
CHANGE TO AUTO FEED MODE
307
304
CHANGE TO MANUAL FEED MODE
308
MANUAL FEED MODE ?
NO
324
AUTO FEED COUNTER CONTROL
O
YES
309
INDICATED NUMBER OF COPIES = 0 ?
NO
YES
310
INPUT BY TEN KEYS ?
NO
YES
311
INDICATE INPUT NUMBER OF COPIES
312
STORE NUMBER OF COPIES
313
SCAN SIGNAL TIMING ?
NO
YES
314
FIRST DOCUMENT SCANNING ?
NO
YES
315
INDICATED NUMBER OF COPIES ← 1
INCREMENT INDICATED NUMBER OF COPIES
316
N

COPYING MACHINE CONTROL SYSTEM

BACKGROUND OF THE INVENTION

1. Field of the Invention

The present invention relates to a control system for a copying machine including a manual feed device to permit copying papers to be manually fed into the machine, and more particularly to a control system adapted to control the manual feed device and an original document conveying device in a collective and coordinated manner when the copying machine operates in a mode associated with the original document conveying device.

2. Description of the Prior Art

Generally, when taking copies with an electrophotographic copying machine in a manual copying paper feed mode, copying papers must be inserted one by one through an inlet of the manual feeding device for each copying action in addition to replacement of an original document on a document supporting glass plate with another. Thus the operation in the manual copying paper feed mode is complicated and troublesome compared with the case of an automatic copying paper feed mode which is carried out simply by changing the original documents and pressing a print key. Furthermore, with most copying machines document changing positions and manual copying paper feeding positions are different, which in practice impairs the efficiency of the manual feed mode copying and impresses the operational complication upon the user.

On the other hand, many proposals have been made concerning an original document conveying device for automatically replacing a document on the document supporting glass plate with another. Examples of such proposals are found in U.S. Pat. Nos. 4,264,188 and 4,365,889. However, none of them provide controls effective to eliminate the complexity of the manual feed mode copying operation.

SUMMARY OF THE INVENTION

An object of the present invention, therefore, is to provide a control system for a copying machine which facilitates the setting of original documents to an exposure position during a copying operation in the manual copying paper feed mode.

In order to achieve the above and other objects, the present invention has an automatic document conveying device and a manual feed device controllably interrelated to each other.

According to one aspect of the invention, a control system for a copying machine comprises a manual feed mode changeover means for switching to a manual paper feed mode which is one of a plurality of paper feed modes, manual paper feed means for permitting copying papers to be manually fed in the manual paper feed mode, document conveyor means for transporting an original document to an exposure position and discharging the original document from the exposure position, switch means disposed adjacent to the manual paper feed means and adapted to output a document change request signal, and control means for actuating the document conveyor means to change original documents in response to the document change request signal output in the manual feed mode.

According to another aspect of the invention, a control system for a copying comprises, manual feed mode changeover means for switching to a manual paper feed mode which is one of the plurality of paper feed modes, manual paper feed means for permitting copying papers to be manually fed in the manual paper feed mode, document conveyor means for transporting an original docuemnt to an exposure position and discharging the original document from the exposure position, setting means for setting a number of copies to be taken from a single document and for outputting a document change request signal when the number of copies set by the setting means have been taken in the manual feed mode, first control means for actuating the document conveyor means to change original documents in response to the document change request signal output, switch means disposed adjacent to the manual paper feed means and adapted to output the document change request signal and second control means for actuating the document conveyor means to change original documents in response to the document change request signal output in the manual feed mode regardless of the number of copies set by the setting means.

With the constructions described above, original documents are automatically changed when a preset number of copies have been taken in the manual feed mode. Furthermore, by pressing the switch disposed adjacent to the manual paper feed means, the copying operation may be stopped and the document conveyor means may be actuated to change original documents.

BRIEF DESCRIPTION OF THE DRAWINGS

The above and other objects and features of the present invention will become apparent from the following description taken in conjunction with the preferred embodiments thereof with reference to the accompanying drawings. In the drawings.

DETAILED DESCRIPTION OF THE INVENTION

An embodiment of the present invention will now be described with reference to the drawings.

Figure 1:
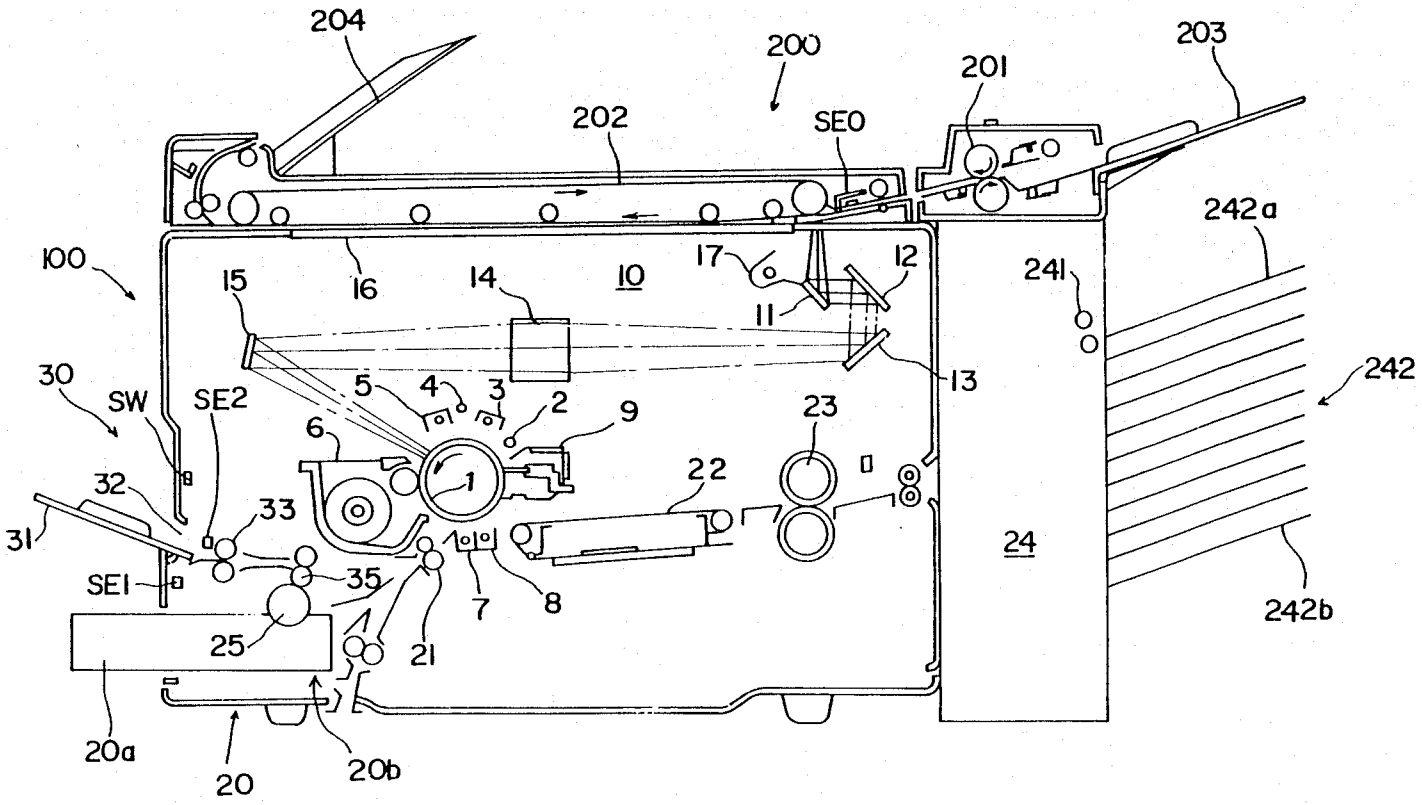
FIG. 1 is a schematic sectional view of a copying machine to which the present invention may be applied.

FIG. 1 shows a copying machine including a manual paper feeding device and operable in association with a original document feeding device. First, an outline of the construction and operation of this copying machine will be described.

The copying machine 100 includes a photoreceptor drum 1 having a photosensitive layer and mounted approximately at a central portion of a machine housing for rotation in the counterclockwise direction in FIG. 1.

Around the photoreceptor drum 1, a main eraser lamp 2, a sub-charger 3, a sub-eraser lamp 4, a main charger 5, a developing device 6, a transfer charger 7, a charger eraser 8, and a cleaning device 9 are sequentially disposed. The photoreceptor drum 1 is charged and sensitized as it passes by the eraser lamps 2 and 4 and the chargers 3 and 5, and receives an image exposure from a scanning optical system 10 whereby an electrostatic latent image is formed on a surface of the drum 1.

The optical system 10 is disposed below a document supporting glass plate 16 to scan a document image, and comprises a light source 17, movable mirrors 11, 12 and 13, a lens 14, and a fixed mirror 15. The light source 17 and the movable mirror 11 are driven to move leftward in the drawing at a velocity v/n (wherein n represents magnification) with respect to a peripheral velocity n of the drum 1 which is constant whether real-size copying or variable magnification copying, occurs whereas the movable mirrors 12 and 13 are driven to move leftward in the drawing at a velocity v/2n with respect to the peripheral velocity n of the drum 1.

Copying papers are fed into the machine 100 by an automatic paper feeding device 20 or a manual paper feeding device 30 disposed at a lefthand side of the machine housing. A copying paper fed into the machine 100 is brought to a halt by timing rollers 21 and is then fed to a transfer station in synchronism with the image formed on the photoreceptor drum 1. In the transfer station the copying paper receives the toner image transferred by the transfer charger 7 and is separated from the surface of the drum 1 by the action of the charge eraser 8. Thereafter the copying paper is transported by a conveyor belt 22 to a fixing deivce 23 where the image is fixed to the paper, and finally to a sorter 24.

After the image transfer, residual toner and electric charge are removed from the surface of the drum 1 by the cleaning device 9 and the eraser 2 whereby the drum 1 is ready for a next copying cycle.

The automatic paper feeding device 20 and the manual paper feeding device 30 may be used selectively. The switching between the two devices 20 and 30 is carried out, for example, by means of a sensor SE1 for detecting opening and closing of a manual feeding table 31 which acts also as a guide for manually fed copying papers. Alternatively, a copying paper fed through a manual feed inlet 32 when the machine is ready to receive it may be detected by a sensor SE2 whereupon manual feed rollers 33 are driven and a copying operation is started.

In the case of automatic paper feeding a print key 71 (FIG. 2) for starting the copying operation is depressed to activate an image forming system including the photoreceptor drum 1 and the scanning optical system 10. As the scanning optical system 10 is activated, a paper feed signal is output to drive a paper feed roller 25 to feed a copying paper in synchronism with an image forming process.

In the case of manual paper feeding, on the other hand, when the sensor SE2 detects a copying paper inserted into the manual feed inlet 32, the paper feed rollers 33 rotate to feed the paper into the copying machine. Simultaneously therewith or after a slight delay therefrom, the photoreceptor drum 1 and the scanning optical system 10 are activated, as at the time of print key depression. The manually fed copying paper is temporarily stopped at conveyor rollers 35, which rotate upon output of the paper feed signal to feed the paper further into the machine. A switch SW disposed adjacent to the paper feeding table 31 is a document changing switch for actuating an automatic document feeding device 200 to change documents as described later. Preferably this switch SW is disposed behind the manual feeding table 31 when the latter is closed into the machine, so that the switch SW is operable by the user only at times of manual copying paper feed.

The automatic document feeding device (hereinafter referred to as ADF) 200 is detachably mounted on a top surface of the copying machine 100. When the ADF 200 is electrically connected to the copying machine 100 and placed in position, controls for the ADF 200 and the copying machine 100 are interrelated to each other and the operating mode of the copying machine 100 is switched to an ADF mode. The ADF mode is a mode for starting the ADF 200 by operating the print key 71 provided on the copying machine 100. When the print key 71 is operated in the ADF mode, document feed rollers 21 and a documet conveyor belt of the ADF 200 are started with the copying machine 100 in a standnby state. A document placed on a document ray 203 is transported along a top surface of the document supporting glass plate 16 and stops at a predetermined position upon lapse of a predetermined time after a leading end thereof passes a document sensor SE0. At this time a start signal is output from the ADF 200 to the copying machine 100 to start the copying operation. Further, in the ADF mode, when the document has been scanned the copying machine 100 transmits an activator signal to the ADF 200 whereupon the ADF discharges the document onto a discharge tray 204. A next document on the document tray 203, if any, is transported to its predetermined position simultaneously with the discharge of the preceding document.

In the case of copying by the manual feed mode, when the document change request switch SW is operated even before the last scanning of the document is completed, the document on the glass plate is discharged and a next document is set in position. The action of the ADf 200 is carried out after the executing scanning is completed if the document change request switch SW is operated during the scanning, and is carried out immediately if the document chnge request switch SW is operated outside the scanning time.

The sorter 24 is disposed at a copying paper discharge portion of the copying machine 100. When the sorter 24 is electrically connected to the copying machine 100, controls for the sorter 24 and the copying machine 100 are interrelated. More particularly, when multicopying is effected with the sorter 24 in a sort mode, a deflecting device 241 moves successively downwardly from a position opposed to an uppermost bin 242*a* to discharge a copying paper into each bin 242. When a multicopying of the document is completed, the deflecting device 241 is returned to the position opposed to the uppermost bin 242*a* and waits there until copying of a next document is started.

Figure 2:
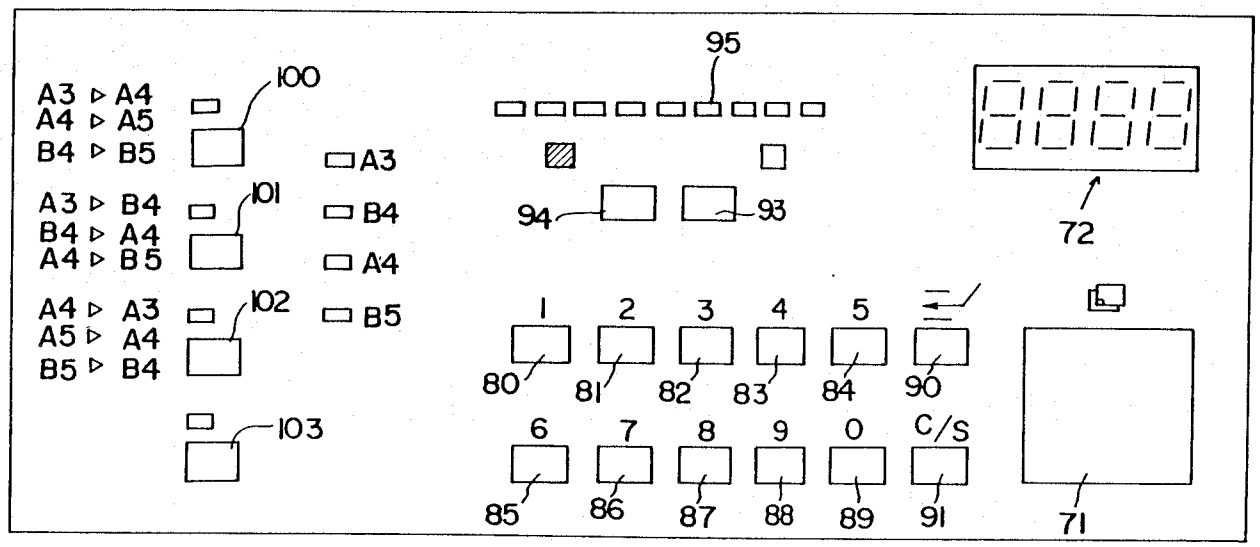
FIG. 2 is a plan view of an operating panel.

FIG. 2 shows an operating panel of the copying machine 100, which includes the print key 71, a copy number indicator 72, copy number setting keys 80–89, an interrupt key 90, a clear-stop key 91, image density setting keys 93 and 94, an image density indicator 95, and magnifying keys 100–103. The copy number setting keys are operable to set a number of copies to be taken by multicopying in both the manual feed mode and the automatic feed mode.

Figure 3:
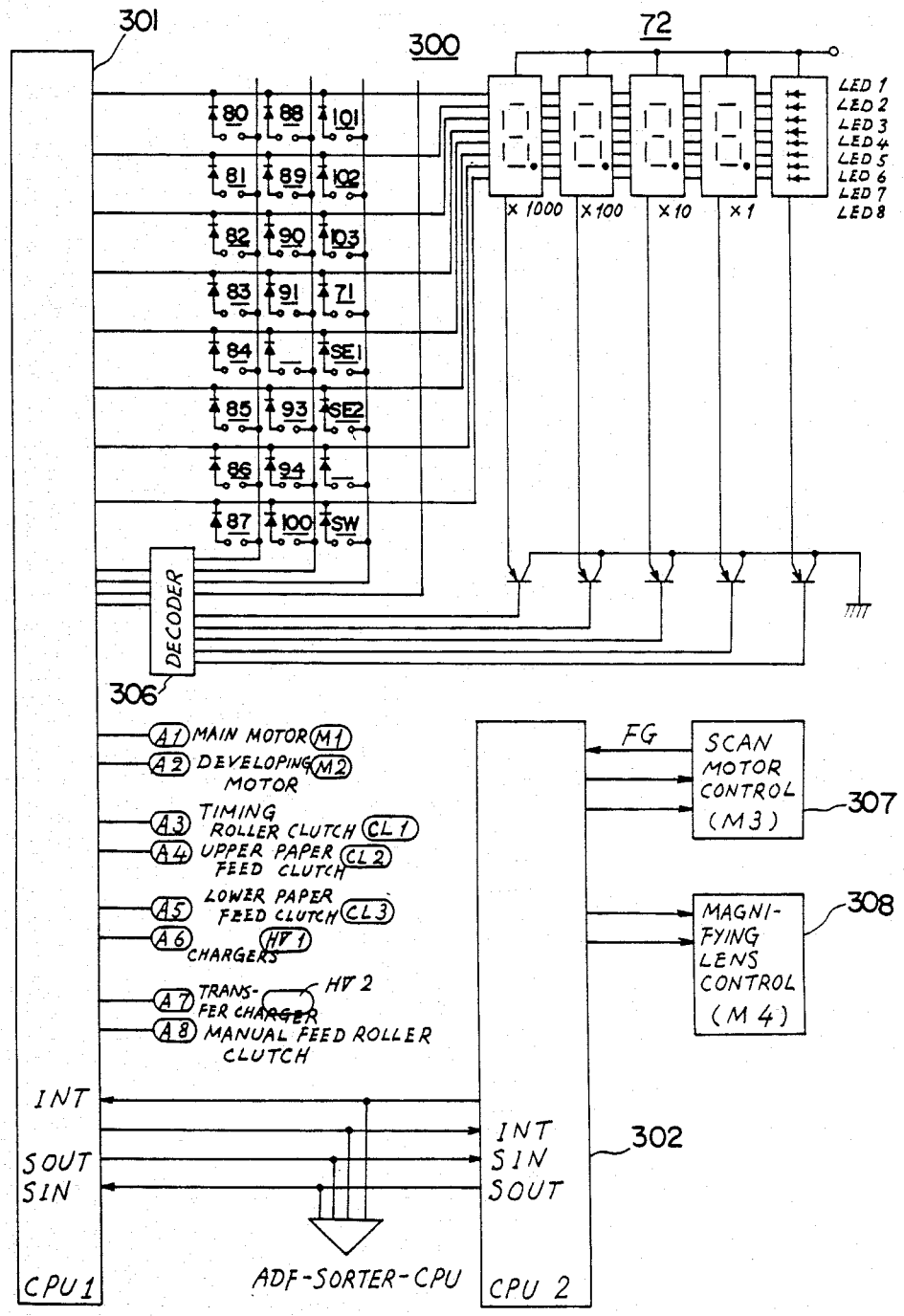
FIG. 3 shows a circuitry employed in the copying machine.

The copying machine 100 having the described construction is associated with a control system 300 including microcomputers, as shown in FIG. 3, to be controllable by a first CPU 301 and a second CPU 302. Furthermore, the control system 300 is associated with control systems (not shown) for the ADF 200 and the sorter 24 to carry out, by exchanging signals among themselves, collective and coordinated controls of the copying machine 100, the ADF 200 and the sorter 24.

The first CPU 301 is connected through a decoder 306 to a key matrix including the copy number setting keys or ten keys 80–89 and the print key 71 arranged on the operating panel of the copying machine 100, the sensor or switch SE1 for detecting opening and closing of the manual feeding table and the sensor or switch SE2 for detecting a manually fed copying paper, to the indicator 72 for indicating a number of copies taken which is determined by operating the ten keys 80–89, and to light emitting diodes for varied indications. For the purpose of controlling the copying machine operation, the first CPU 301 has output ports connected to drive circuits (not shown) for a main motor, a developing motor, clutches and chargers, and further having an interrupt signal output terminal INT and data input terminals Sin and Sout connected to the second CPU 302 and control circuits (not shown) for the ADF 200 and the sorter 24.

The second CPU 302 is adapted to control the optical system 10 of the copying machine 100 and connected to a scan motor control circuit 307, a magnifying lens control circuit 308 and various detector switches (not shown) for the optical system.

The control sequence of the above control system or circuit 300 for controlling the copying machine 100, the ADF 200 and the sorter 24 in an interrelated manner will be described hereinafter with reference to flow charts shown in FIGS. 4 through 10.

Figure 4:
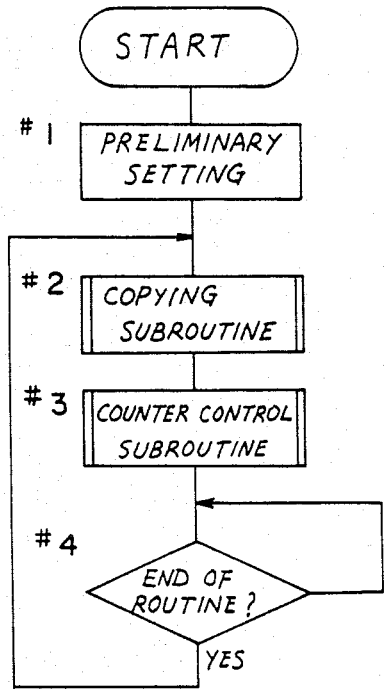
FIG. 4 is a flow chart showing an outline of copying machine control, FIGS. 5*a, b, c* and *d* are flowcharts showing details of a copying subroutine, FIGS. 6*a* and *b* are flowcharts showing details of a counter control subroutine.

FIG. 4 shows a flow chart in a summarized form of controls for the copying machine 100. When a power is switched on, an initial setting is performed at step 1. The initial setting means the processes to establish variable operational settings for the copying machine 100 at standard values such as setting the copy number indicator 71 to "1" and the image density indicator 95 to a median density, and to clear RAM's and resistors in the CPU's.

Figure 5:
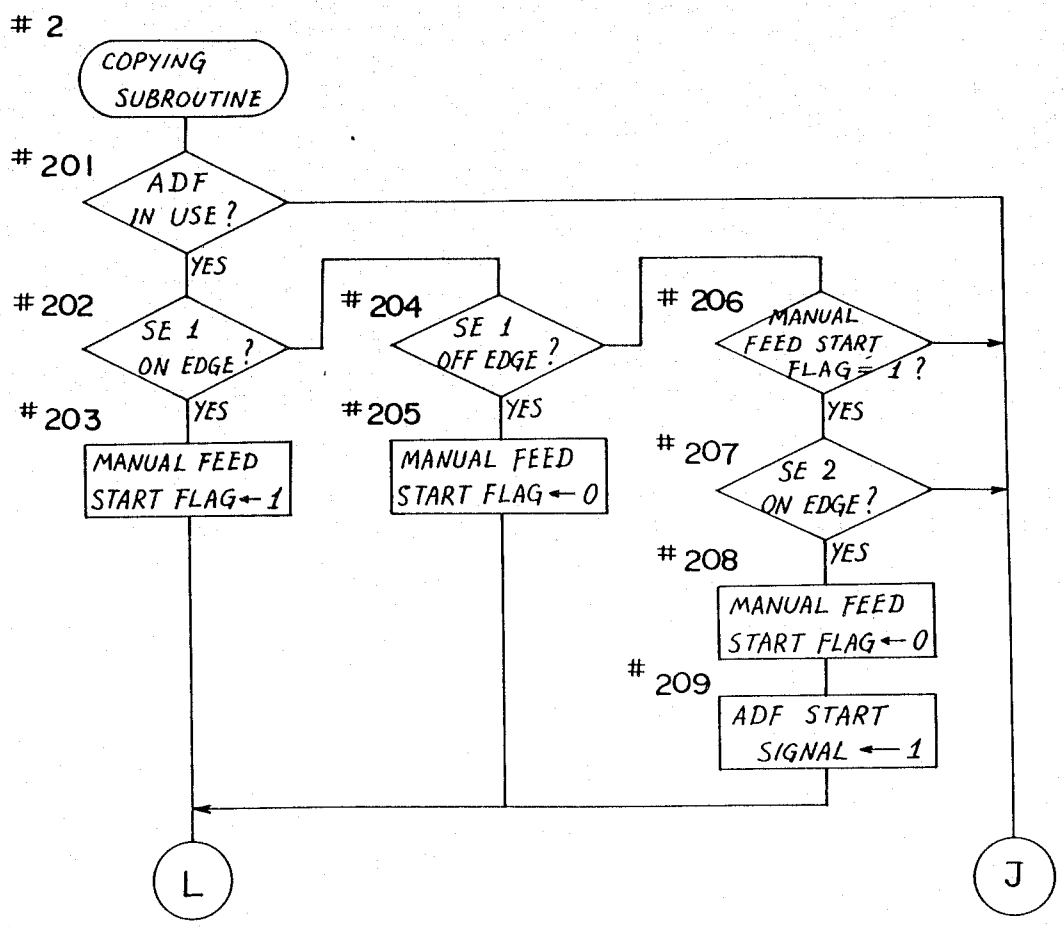
Figure 5:
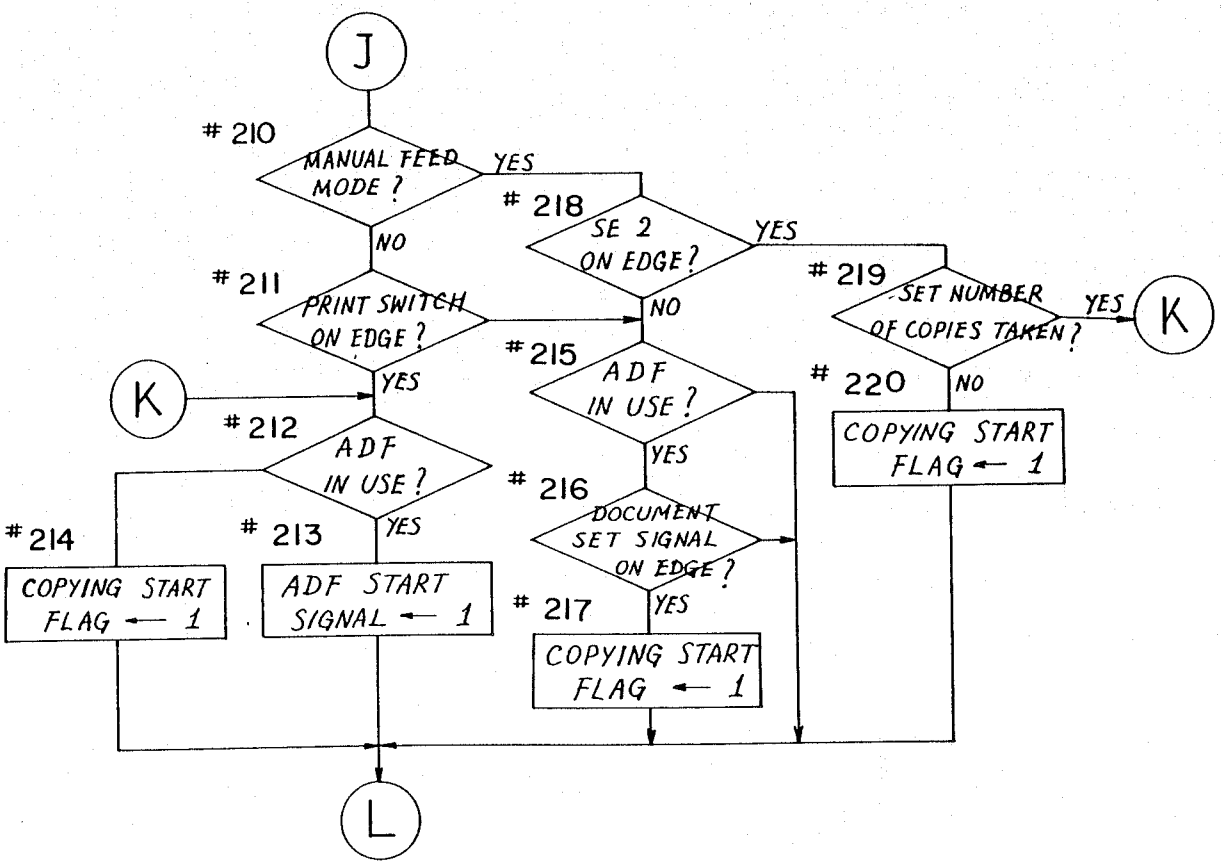
Figure 5:
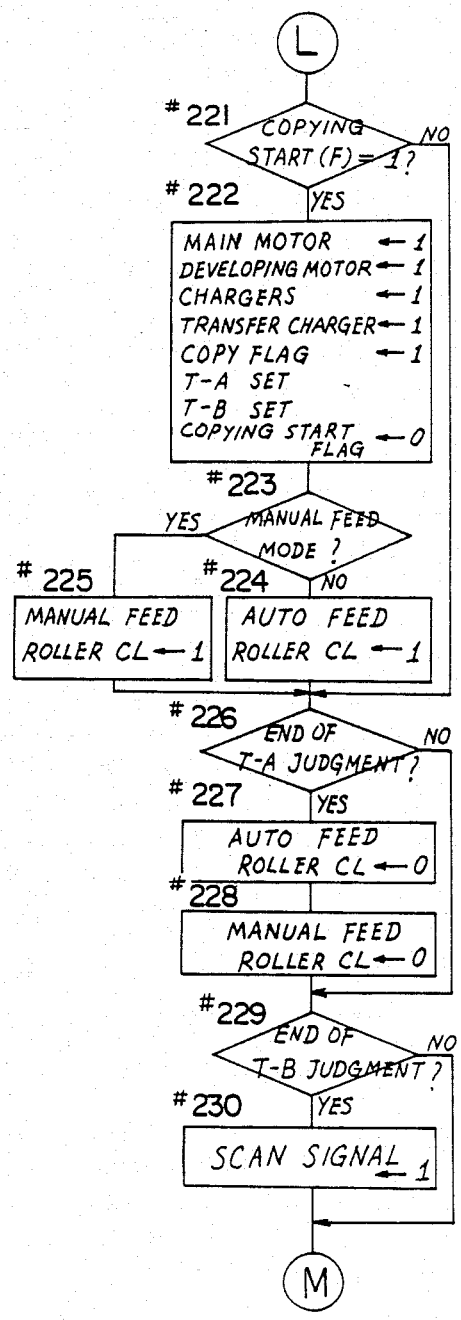
Figure 5:
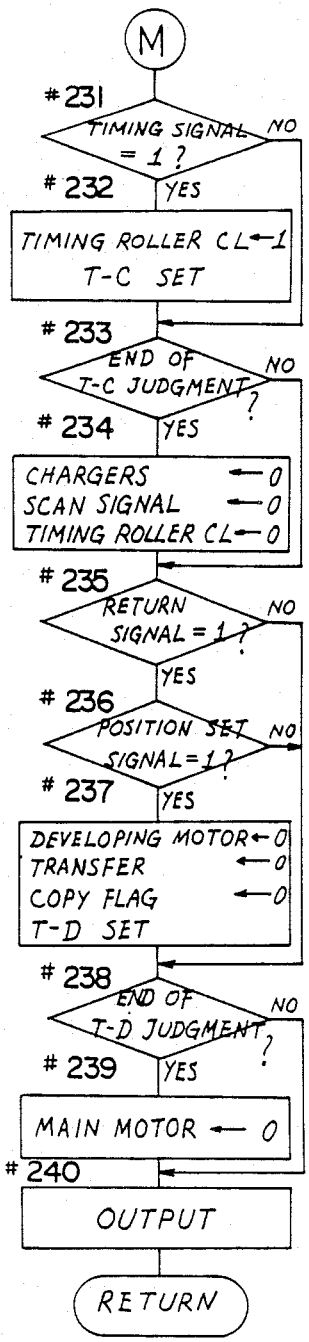

Step 2 is a copying subroutine for actuating the elements of the copying machine 100 to take copies. Details of step 2 are shown in FIG. 5.

Figure 6B:
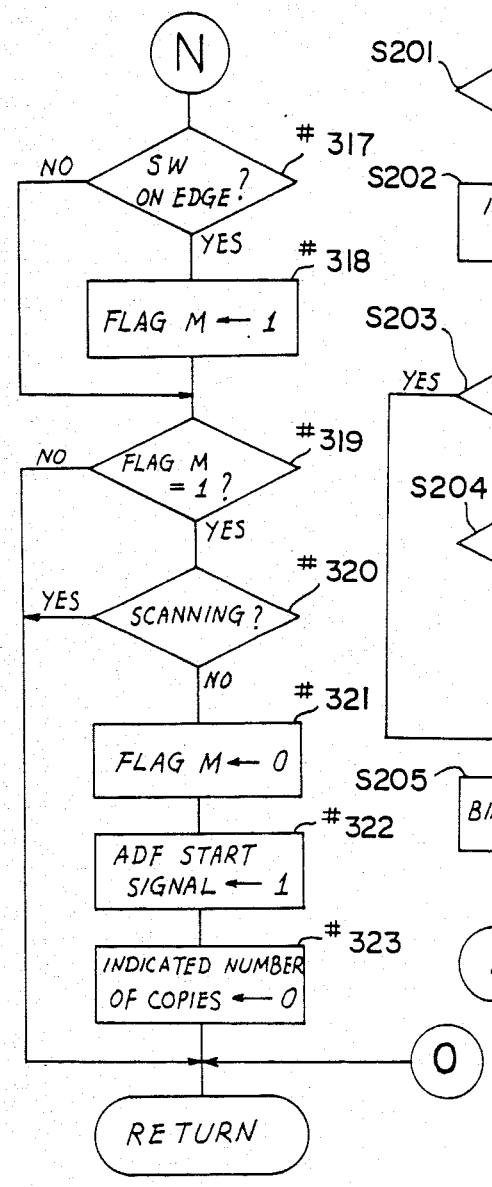

Step 3 is a counter control subroutine for varying, storing and re-indicating the number of copies indicated by the indicator 71, in accordance with operating modes of the copying machine 100. Details of step 3 are shown in FIG. 6.

At step 4 a decision is made as to elapse of a time period defined by an internal timer which is provided to make a program processing time of the first CPU 301 to be constant regardless of the nature of processing. Each time the time period elapses, the control returns to the step 2 to repeat the above processing routines.

FIGS. 5*a, b, c* and *d* are flow charts showing details of the copying subroutine. At steps 201 to 209 the ADF 200 is actuated to place a document in position on the glass plate when, in the manual copying paper feed utilizing the ADF 200, the manual feeding table 31 is opened and a first copying paper is manually fed.

At step 201 a decision is made as to whether or not the ADF is ready for use. In the case of "YES", when the opening of the manual feeding table 31 is detected at step 202, a manual feed start flag is set to "1" at step 203. On the other hand, when the closing of the manual feeding table 31 is detected at step 204, the manual feed start flag is set to "0" at step 205.

At step 206, a decision is made as to whether the manual feed start flag is set to "1" or "2". In the case that the flag is set to "1", when a leading end of the manually fed copying paper is detected at step 207, the flag is set to "0" at step 208 and an ADF start signal is set to "1" at step 209. In actual situations the ADF 200 is actuated by this ADF start signal, as particularly described later, to place a first document in position on the document supporting glass plate 16 for the manual copying paper feed mode.

At steps 210 to 220, the copying machine 100 starts a copying taking operation according to a copying paper feed mode and the ADF is actuated to set or change the documents for a second and subsequent copying of papers in the manual feed mode started after the manual feeding table 31 is opened or for the automatic copying paper feed mode.

At step 210 a decision is made as to whether the copying machine 100 is to operate in the manual feed mode or the automatic feed mode. In the case of the automatic feed mode the step 211 follows, and in the case of the manual feed mode the step 218 follows. The mode setting process is carried out at steps 310 to 316 to be described later.

At step 211 an ON-edge of the print key 71 is determined. When the ADF 200 is detected to be in use at step 212, an ADF start signal for actuating the ADF 200 is output at step 213. On the other hand, when the ADF 200 is detected to be out of use, a copy start flag for starting the copying operation is set to "1" l at step 214.

After the print key 71 is accepted, the control sequence proceeds from step 211 to step 215.

When the ADF 200 is decided to be in use at step 215 and an ON-edge of a document setting signal which is output upon placement of a document in position by the ADF 200 is determined at step 216, the copy start flag is set to "1" at step 217.

In other words, when the print key 71 is depressed in the automatic copying paper feed mode, the copying machine 100 starts the copying operation after the ADF 200 starts and places the document in position if the ADF 200 is used, and starts the copying operation immediately if the ADF 200 is out of use.

At step 218 a decision is made as to whether a copying paper is manually fed or not in the manual feed mode by determining an on-edge state of the sensor SE2. When the copying paper is manually fed, a decision is made as to whether or not a preset number of copies have been taken in the manual feed mode at step 219. In the case of "NO", the copy start flag is set to "1" at step 220.

If the number of copies set for the manual feed mode is found to have been taken at step 219, the control sequence proceeds to steps 212 to 214. Then, the ADF start signal is output if the ADF 200 is used, and the copy start flag is set to "1" if the ADF 200 is out of use.

In other words, in the manual feed mode, the same document is multicopied until a preset number of copies are taken without actuating the ADF 200. When the preset number of copies have been taken and thereafter a subsequent copying paper is fed manually, the ADF 200 is actuated to discharge the document that has been multicopied and to transport a next document onto the glass plate and place it in position. The the newly placed document is copied onto the copying papers fed manually.

At steps 221 to 240 processings are carried out to actuate the various elements of the copying machine 100. At step 221 a decision is made as to whether or not the copy start flag is set to "1". If the copy start flag is set to "1", the main motor, the developing motor, and the chargers including the transfer charger are energized, a copy flag is set to "1", the copy start flag is set to "0", and timers T-A and T-B are set at step 222. Further, at step 223 the copying paper feed mode for the copying machine 100 is determined. In the case of the automatic feed mode, the automatic feed roller clutch is energized at step 224. In the case of the manual feed mode, the manual feed roller clutch is energized at step 225. Thus, copying paper feeding is started in either mode. It is to be noted that in an actual situation actuating signals for the elements of the copying machine are output at step 240.

At steps 226 to 232, the copying paper fed into the machine is stopped before the timing rollers 21 to wait for a timing signal output as a result of movement of the optical system, and a leading end of the copying paper and a leading end of an image are synchronized by actuating the timing rollers 21 in a timed relationship with the timing signal output.

At steps 233 and 234, the chargers are turned off, a scan signal is set to "0" and the timing roller clutch is turned off to stop image forming upon lapse of a predetermined time after the timing signal output.

At steps 235 to 237, the developing motor and the transfer charger are turned off, the copy flag is set to "0" and a timer T-D is set when the scanning optical system 10 returns to a normal position.

At steps 238 and 239, the main motor is stopped after the timer T-D comes to an end.

At step 240, the signals output in the above routine are transmitted in one go to the elements of the copying machine.

FIG. 6 is a flow chart showing details of the counter control subroutine.

At steps 301 to 307, the copying paper feed modes are switched by opening and closing of the manual feeding table 31. When the on-edge state of the sensor SE1 for deteting the opening of the manual feeding table 31 is detected at step 301, the number of copies currently indicated by the indicator 72 is stored at step 302, the figure on the indicator 72 is changed to "0" at step 303, and the paper feed mode is switched to the manual feed mode at step 304. On the other hand, when the closing of the manual feeding table is detected at step 305, the number of copies stored at the step 302 is indicated again by the indicator 72 at step 306 and the paper feed mode is switched to the automatic feed mode at step 307.

At step 308, a decision is made as to whether or not the paper feed mode is the manual feed mode. In the case of the manual feed mode, counter control for the manual feed mode is effected at steps 309 to 323. In the case of the automatic feed mode, counter control for the automatic feed mode is effected at step 324. Regarding the counter control for the automatic feed mode, many variations have been proposed and practiced and, since such a counter control is outside the scope of the present invention, its detailed explanation is omitted from this specification.

At steps 309 to 312, a number input by means of the ten keys is indicated by the indicator 72 and at the same time stored as the number of copies taken by the multicopying manual feed mode.

At steps 313 to 316, number "1" is indicated by the indicator 72 when the scanning optical system 10 finishes scanning the first document, and one is added to the number on the indicator 72 when each succeeding scanning is completed.

Steps 317 to 323 are steps taken when the document change request switch SW is operated.

At steps 317 and 318, a document change flag M is set to "1" when an ON-edge of the document change request switch SW is detected.

At steps 319 to 323, when the document change flag M is set to "1" and the scanning optical system 10 is not in the scanning action, the flag M is set to "0", the ADF start signal is output, and the indication on the indicator 71 is changed to "0".

In other words, in the manual feed mode the number of copies to be taken may be input by means of ten keys and, even when the input number of copies have not been taken, the multicopying of the document may be terminated and a next document may be placed on the document supporting glass plate by operating the document change request switch SW. This document change request switch SW is disposed at the manual feeding device 30 to be readily accessible during the manual feed mode operation.

Figure 7:
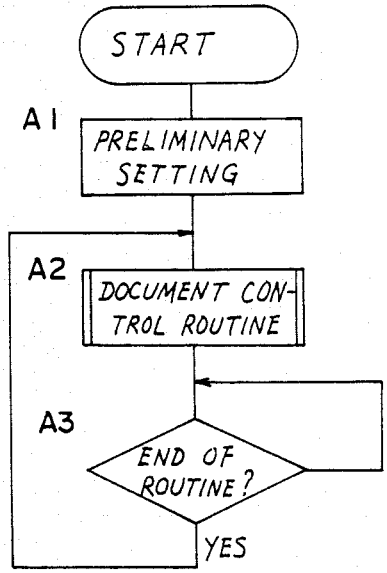
FIG. 7 is a flow chart showing an outline of ADF control.

FIG. 7 shows a flow chart in a summarized form of the controls for the ADF 200. At step A1 a CPU (not shown) for controlling the ADF 200 is initialized. Step A2 is a document control subroutine for transporting a document from the document tray 203 to the predetermined position on the document supporting glass plate and, after copying, discharging the document onto the document discharge tray 204. Details of this subroutine will be described with reference to FIG. 8. At step A3 a decision is made as to termination of a timer for making a routine processing time constant.

Figure 8:
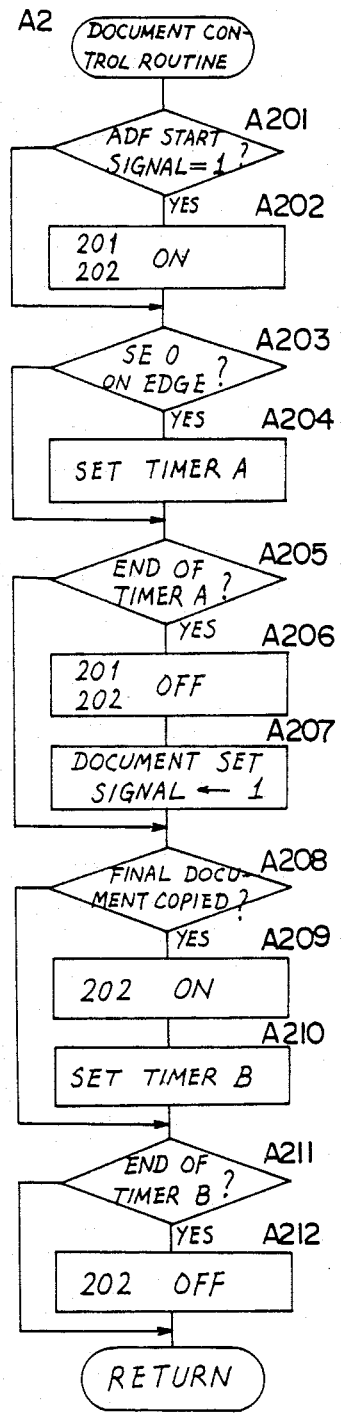
FIG. 8 is a flow chart showing details of a document control subroutine.

Referring to FIG. 8 showing the details of the document control subroutine, the document feed rollers 201 and the document conveyor belt 202 are driven at steps A201 and A202 when the ADF start signal is detected. The ADF start signal is output at step 204 when the print key 71 is depressed, when the first copying paper is manually fed in the manual feed mode, and when multicopying is completed, and at step 322 when the document change request switch SW is pushed in the manual feed mode.

At steps A203 to A207, the document feed rollers 201 and the document conveyor belt 202 are stopped to place the document in the predetermined position and to output the document setting signal upon lapse of a predetermined time after the document detecting sensor SE0 detects a leading end of the document fed in. The copying operation is started by detecting the document setting signal at the step 216.

At steps A208 to A 212, when final scanning of the document placed in position on the document supporting glass 16 is completed, the document conveyor belt 202 is driven for a predetermined time to discharge the copied document onto the discharge tray 204.

Figure 9:
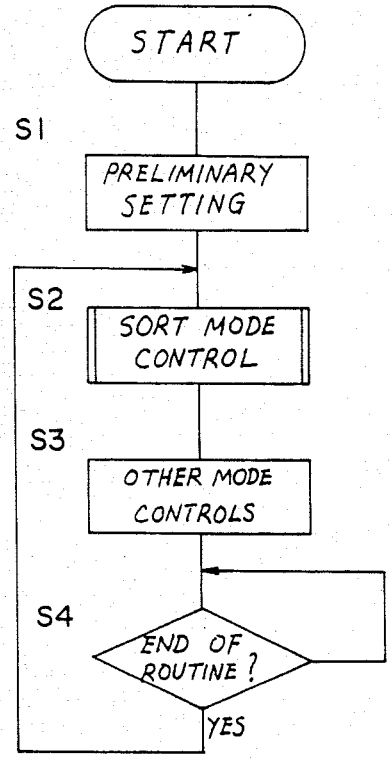
FIG. 9 is a flow chart showing an outline of sorter control.

FIG. 9 is a flow chart in a summarized form of the controls for the sorter 24. At step S1, a CPU (not shown) for controlling the sorter 24 is initialized and the deflecting device 241 is set to the position opposed to the uppermost bin 242*a*. Step S2 is a sort mode control subroutine for causing the copying papers discharged from the copying machine 100 to be received by the sorter 24 in the sort mode. Details of this subroutine are described with reference to FIG. 10. Step S3 is for controlling other modes than the sort mode, such as a stack mode, a grouping mode, etc. At step S4 a decision is made as to termination of a timer for making a routine processing time constant.

Figure 10:
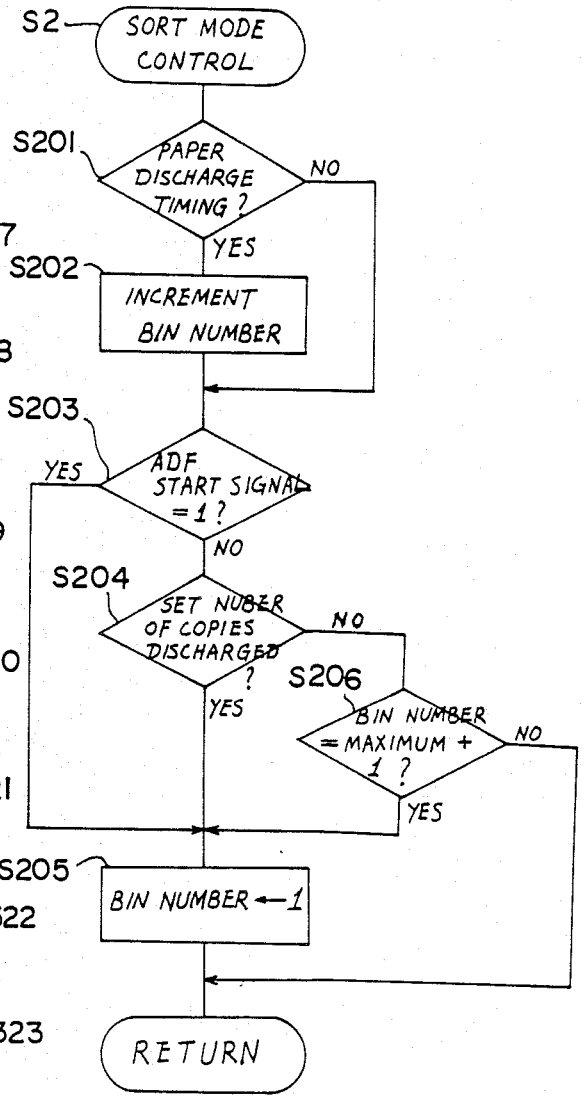
FIG. 10 is a flow chart of sort mode control subroutine.

FIG. 10 is a flow chart showing the details of the sort mode control subroutine. The sort mode is a mode for placing copying papers continuously discharged from the machine in multicopying one in each bin 242.

At steps S201 and S202, bin numbers are incremented in a timed relationship with the discharge of the copying papers from the copying machine 100. More particularly, when the deflecting device 241 is in a position opposed to a bin numbered "1", the bin number "1" is changed to "2" timed with the discharge of a copying paper from the copying machine 100. And after the copying paper is discharged to that bin, the deflecting device 241 is moved to a position opposed to a bin with the incremented number "2".

At step S203, a decision is made as to whether or not the ADF start signal is "1". If it is "1", step S205 follows and the bin number is set to "1". If it is "0", step 204 follows. The ADF start signal becomes "1" when the document change request switch SW is pushed in the manual feed mode utilizing the ADF 200 or when multicopying utilizing the ADF 200 is completed.

At step S204 a decision is made as to whether or not the number of copying papers preset by means of the ten keys have been discharged. In the case of "YES" the control sequence proceeds to step S205 and the bin number is set to "1". If the preset number of copying papers have not been discharged, the control sequence proceeds to step S206 at which a decision is made whether or not the bin number is greater by one than a maximum number of bins. When the bin number does not exceed the maximum number of bins, the control sequence makes a return. When the bin number is greater by one than the maximum number of bins, the control sequence proceeds to step S205.

Thus, in the above mode, the preset number of copying papers continuously discharged are placed in the uppermost bin 242*a* and next bins below successively by moving the deflecting device 241, and the deflecting device 241 is returned to the position opposed to the uppermost bin 242*a* when the preset number of copying papers are placed in the bins. When the preset number of copying papers is greater than the number of bins in the sorter 24, the uppermost bin 242*a* and the bins successively below receive the copying papers all over again after a lowermost bin 242*b* has received one and this is repeated until the preset number of papers are all placed in the sorter. When the preset number of copying papers have been placed in the sorter, the deflecting device 241 is returned to the position opposed to the uppermost bin 242*a*.

The control as above is performable when multicopying is set by means of the ten keys whether the manual feed mode or the automatic feed mode. Furthermore, when the document change request switch SW is pushed in the manual feed mode utilizing the ADF 200, the deflecting device 241 of the sorter 242 is returned to the position opposed to the uppermost bin 242*a* to be ready to carry out the copying paper sorting for a next document.

For multicopying a plurality of documents in the manual copying paper feed mode with the described embodiment, the manual feeding table 31 is opened to set the copying machine 100 to the manual feed mode, the documents are set on the document tray 203 of the ADF 200, and the number of copies to be taken is registered by means of the ten keys on the operating panel. When a first copying paper is fed in the manual feed mode, the ADF 200 is actuated to place a document in position on the document supporting glass plate whereupon the manual feed mode copying operation is started. For a second copying paper to the last in the number of copying papers preset by means of the ten keys, the copying is carried out without actuating the ADF 200.

When the number of copies preset by means of the ten keys have been taken, the ADF 200 is actuated to change the documents whereupon multicopying in the manual feed mode for the new document is ready to take place.

When replacement of the document being copied is desired during the multicopying in the manual feed mode with the preset number of copies uncompleted, the multicopying in the manual feed mode may be interrupted and the ADF 200 is actuated to change the documents by pushing the document change request switch SW.

Furthermore, the copying papers in the manual feed multicopying are sortable by the sort mode utilizing the sorter 24.

Still further, by pushing the document change request switch SW during the manual feed multicopying utilizing the ADF 200 with the sorter 24 operating in the sort mode, the documents may be changed and the deflecting device 241 of the sorter 24 may be returned to the position opposed to the uppermost bin 242*a* to be ready to carry out the copying paper sorting for the next document.

As will be clearly understood from the foregoing description, the control system for the copying machine according to the present invention facilitates setting of documents to the exposure position for the manual feed copying. Moreover, the operator is completely freed from the trouble of changing the documents by the arrangement that the number of copies to be taken in the manual feed multicopying is registered by means of the ten keys and the document conveying device is automatically actuated when the preset number of copies have been taken. The provision of the document change request switch permits the manual feed multicopying to be stopped at any time for document changing, which promotes flexibility of multicopying.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A control system for a copying machine operable in a plurality of paper feed modes, comprising:

manual feed mode changeover means for switching to a manual paper feed mode which is one of the plurality of paper feed modes;

manual paper feed means for feeding copying papers;

document conveyor means for transporting an original document to an exposure position and discharging the original document from the exposure position;

switch means disposed adjacent to the manual paper feed means and adapted to output a document change request signal; and control means for actuating the document conveyor means to change original documents in response to the document change request signal output in the manual feed mode.

2. A control system as claimed in claim 1 wherein said control means actuates the document conveyor means after completion of exposure of the document when the document change request signal is output during the exposure.

3. A control system as claimed in claim 1 wherein the manual paper feed means includes a manual feeding table movable between an operative position for permitting manual paper feeding and a contained inoperative position, the document change request switch being disposed in a position accessible when the manual feeding table is in the operative position and inaccessible when the manual feeding table is in the inoperative position.

4. A control system as claimed in claim 3 wherein the manual feeding table is adapted to open and close, the switch being inaccessible when the table is closed.

5. A control system as claimed in claim 4 wherein the manual feed mode changeover means includes sensor means for detecting the opening and closing of the manual feeding table.

6. A control system as claimed in claim 4 wherein the manual feed mode changeover means includes sensor means for detecting a copying paper manually inserted into the manual paper feed means.

7. A control system for a copying machine operable in a plurality of paper feed modes, comprising:

manual feed mode changeover means for switching to a manual paper feed mode which is one of the plurality of paper feed modes;

manual paper feed means for feeding copying papers manually inserted into a manual feed inlet;

document conveyor menas for transporting an original document to an exposure position and discharging the original document from the exposure position;

switch means disposed adjacent to the manual paper feed means and adapted to output a document change request signal;

sorter means including a plurality of bins and adapted to sort image-carrying copying papers by placing the copying papers in an uppermost bin first and then next bins therebelow successively; and control means for actuating the document conveyor means to change original documents in response to the document change request signal output in the manual feed mode, and for returning the sorter means to an initial mode to place the image-carrying copying papers in the uppermost bin and next bins therebelow successively.

8. A control system as claimed in claim 7 wherein said control means actuates the document conveyor means after completion of exposure of the document when the document change request signal is output during the exposure.

9. A control system for a copying machine operable in a plurality of paper feed modes, comprising:

manual feed mode changeover means for switching to a manual paper feed mode which is one of the plurality of paper feed modes;

manual paper feed means for feeding copying papers manually inserted into a manual feed inlet;

document conveyor means for transporting an original document to an exposure position and discharging the original document from the exposure position;

setting means for setting a number of copies to be taken from a single document and for outputting a document change request signal when the number of copies set by the setting means have been taken in the manual feed mode;

first control means for actuating the document conveyor means to change original documents in response to the document change request signal output;

switch means disposed adjacent to the manual paper feed means and adapted to output the document change request signal; and second control means for actuating the document conveyor means to change original documents in response to the document change request signal output in the manual feed mode regardless of the number of copies set by the setting means.

10. A control system as claimed in claim 9 wherein the second control means actuates the document conveyor means after completion of exposure of the document when the document change request signal is output during the exposure.

11. A control system as claimed in claim 10 further comprising sorter means including a plurality of bins and adapted to sort image-carrying copying papers by placing the copying papers in an uppermost bin first and the next bins therebelow successively, the control means being operable, in response to the document change request signal output in the manual feed mode, to actuate the document conveyor means to change documents and to return the sorter means to an initial mode to place the image-carrying copying papers in the uppermost bin and next bins therebelow successively.

12. The invention of claim 9 wherein the manual paper feed means includes a feed table that is movably mounted on the copying machine and the switch means includes a sensor switch that is responsive to the position of the feed table.

* * * * *